US009890475B2

(12) United States Patent
Maly et al.

(10) Patent No.: US 9,890,475 B2
(45) Date of Patent: Feb. 13, 2018

(54) METHOD AND DEVICE FOR APPLICATION OF LIQUID POLYMERIC MATERIAL ONTO SPINNING CORDS

(75) Inventors: Miroslav Maly, Visnova (CZ); Pavel Sejak, Liberec (CZ); Vit Stromsky, Liberec (CZ); Milan Nydrle, Liberec (CZ); Michal Bittner, Liberec (CZ); Ladislav Mares, Liberec (CZ); Jan Cmelik, Liberec (CZ); Lenka Hanusova, Liberec (CZ); Martin Podany, Liberec (CZ); Radim Krenek, Liberec (CZ)

(73) Assignee: Elmarco S.R.O, Liberec (CZ)

( * ) Notice: Subject to any disclaimer, the term of this patent is extended or adjusted under 35 U.S.C. 154(b) by 994 days.

(21) Appl. No.: 14/005,714

(22) PCT Filed: Feb. 27, 2012

(86) PCT No.: PCT/CZ2012/000019

§ 371 (c)(1),
(2), (4) Date: Nov. 19, 2013

(87) PCT Pub. No.: WO2012/139533

PCT Pub. Date: Oct. 18, 2012

(65) Prior Publication Data

US 2014/0061959 A1 Mar. 6, 2014

(30) Foreign Application Priority Data

Apr. 12, 2011 (CZ) ..... 2011-212

(51) Int. Cl.
*D01D 5/00* (2006.01)

(52) U.S. Cl.
CPC ..... *D01D 5/0069* (2013.01); *D01D 5/003* (2013.01)

(58) Field of Classification Search
CPC ..... D01D 5/0069; D01D 5/003
See application file for complete search history.

(56) References Cited

U.S. PATENT DOCUMENTS 3,406,660 A 10/1968 Simm
3,994,258 A 11/1976 Simm
(Continued)

FOREIGN PATENT DOCUMENTS

CZ 2005-360 1/2007
CZ 2007-179 9/2008
(Continued)

OTHER PUBLICATIONS

International Search Report and Written Opinion dated Jul. 4, 2012 issued in corresponding International patent application No. PCT/CZ2012/000019.

(Continued)

*Primary Examiner* — Robert J Grun
(74) *Attorney, Agent, or Firm* — Dority & Manning, P.A.

(57) ABSTRACT

The present disclosure relates to a method and a device for application of liquid polymeric material onto the active spinning zone of the cord of the spinning member of the spinning electrode, where the application means moving reversibly along the active spinning zone of the cord in the device for production of nanofibres through electrostatic spinning of liquid material in electrostatic field of high intensity between at least one spinning electrode and against it arranged collecting electrode. The liquid polymeric material is applied onto the cord around its whole circumference without any contact with gaseous environment in the spinning space, where the application means reversibly moves, whereas while the cord is leaving the application means the thickness of the layer of the liquid polymeric material is being reduced and immediately after leaving the application (Continued)

means the process of electrostatic spinning of the liquid polymeric material applied on the cord is started.

14 Claims, 4 Drawing Sheets

(56) References Cited

U.S. PATENT DOCUMENTS

| | | | |
|---|---|---|---|
| 4,144,553 | A | 3/1979 | Schmidt et al. |
| 4,230,650 | A | 10/1980 | Guignard |
| 4,287,139 | A | 9/1981 | Guignard |
| 6,604,925 | B1 | 8/2003 | Dubson |
| 7,585,437 | B2 | 9/2009 | Jirsak et al. |
| 7,967,588 | B2 | 6/2011 | Green et al. |
| 8,231,822 | B2 | 7/2012 | Petras et al. |
| 9,101,860 | B2 | 8/2015 | Green et al. |
| 9,279,195 | B2 | 3/2016 | Petras et al. |
| 2006/0049542 | A1 | 3/2006 | Chu et al. |
| 2008/0150197 | A1 | 6/2008 | Chang et al. |
| 2009/0148547 | A1 | 6/2009 | Petras et al. |
| 2010/0272847 | A1 | 10/2010 | Mares et al. |

FOREIGN PATENT DOCUMENTS

| | | |
|---|---|---|
| CZ | 2006-545 | 12/2008 |
| DE | 101 36 255 A1 | 2/2003 |
| DE | 10136255 | 2/2003 |
| EP | 2 173 930 A2 | 4/2010 |
| WO | WO 2005/024101 | 3/2005 |

OTHER PUBLICATIONS

International Search Report for PCT/CZ2012/000019 dated Apr. 7, 2012, 2 pages.

International Preliminary Report on Patentability for PCT/CZ2012/000019 dated Oct. 15, 2013, 7 pages.

METHOD AND DEVICE FOR APPLICATION OF LIQUID POLYMERIC MATERIAL ONTO SPINNING CORDS

CROSS-REFERENCE TO RELATED APPLICATIONS

The present application is a 35 U.S.C. § 371 National Phase conversion of PCT/CZ2012/000019, filed Feb. 27, 2012, which claims benefit of Czech Republic Application No. PV 2011-212, filed Apr. 12, 2011, the disclosure of which is incorporated herein by reference. The PCT International Application was published in the English language.

TECHNICAL FIELD

The invention relates to a method for application of liquid polymeric material onto active spinning zone of a cord of spinning member of spinning electrode byan application means moving reversibly along the active spinning zone of the cord in a device for production of nanofibres through electrostatic spinning of liquid material in electrostatic field of high intensity between at least one spinning electrode and against it arranged collecting electrode.

Further the invention relates to a device for application of liquid polymeric material onto active spinning zone of a cord of a spinning member of a spinning electrode in a device for production of nanofibres through electrostatic spinning of liquid material in electrostatic field of high intensity between at least one spinning electrode and against it arranged collecting electrode, whereas the device comprises a carrying body placed reversibly displaceably along the active spinning zone and coupled with a drive and with a reservoir of the liquid polymeric material.

BACKGROUND ART

The EP 2173930 describes the device for production of nanofibres through electrostatic spinning of liquid material in electrostatic field between at least one spinning electrode and against it arranged collecting electrode. The spinning electrode comprises at least one spinning member comprising the cord, which comprises the straight section, which is parallel with the plane of depositing of nanofibres and/or with the collecting electrode and it forms an active spinning zone of the cord. The cord of the spinning member is stationary, or it is displaceable along its length, or it is movable continuously or discontinuously along its length and it comprises at least one active spinning zone, which is in stable position with respect to the collecting electrode. To the cord there is assigned a device for applying the liquid material onto the cord in direction of length of the cord, whereas the device is placed reversibly displaceably in the carrying body of the spinning electrode along the active spinning zone of the cord. The EP 2173930 describes number of variants of the arrangement of the cord of the spinning member, in one of them the cord is placed movably in the direction of its length, whereas its final length is several times bigger than the length of the active spinning zone of the cord. The beginning of the cord is placed on the unwinding reel, which is coupled with a drive or with a brake to secure defined tension of the cord. The winding reel is coupled with the winding drive to secure movement speed of the cord. The EP 2173930 describes number of variants of application means, which are arranged reversibly displaceably along the length of the active spinning zone of the cord, for example the capillary application means, into which there is brought liquid material is brought, which is forced out from them and sticks on the active spinning zone of the cord. The capillary application means move under the active spinning zone of the cord and the described variants comprise one or two capillary application means for one cord. The movement of application means is as frequent and fast as to be enough liquid material for spinning in the active spinning zone of the cord. A disadvantage of the capillary application means is possibility of clogging-up of the capillaries, especially with the drying out and ageing liquid polymeric material, which is in contact with air. Another disadvantage of the capillary application means is that it is difficult to regulate it, especially with respect to polymer consumption. Application of Polymeric material onto the active zone of the cord from the bottom side of the cord does not always guarantee the same and uniform polymeric material layer on the top side of the spinning cord. Other variants of application devices comprise the application roller, which is common for several cord active zones, under which is rotatingly mounted in the polymeric material reservoir, whereas is mounted together with reservoir of polymeric material reversibly displaceably along the active spinning zones of cords. The roller by its surface carries out the liquid material from the reservoir and applies it on the active spinning zone of the cords. The disadvantage of this arrangement is the fact that in case of most of polymeric materials the spinning effect probably occurs also on the roller surface off the cords. This disadvantage is eliminated by the next described invention embodiment, where the roller is replaced by a system of disks, whereas one disk is assigned to each cord. Application devices with neither the application roller nor the application disks are able to ensure in long term the constant quality of the polymeric material layer on the top side of the spinning cord, especially because of high quantity of polymer that being in contact with environment. Another disadvantage is free level of polymer in the reservoir from which solvent evaporates, which even in case of mixing results in faster ageing of the polymeric material mixing.

The goal of the invention is to eliminate or at least reduce the disadvantages of background art.

SUMMARY OF THE INVENTION

The goal of the invention is achieved by a method for application of liquid polymeric material according to the invention, which principle consists in that the liquid polymeric material is applied on the cord around its whole circumference without any contact with gaseous environment in the spinning space, where the application means reversibly moves, whereas the thickness of the layer of the liquid polymeric material is being reduced when the cord leaves the application means and immediately after leaving the application means the process of electrostatic spinning of the liquid polymeric material applied on the cord is started.

The technique according to the invention prevents evaporation of solvent from the liquid polymeric material during application on the cord and so ageing of the liquid polymeric material is slowed down. The spinning process runs after the cord leaves the application means and only from the layer stuck on the cord, which improves uniformity of produced nanofibres.

The thickness of the layer of the liquid polymeric material on the cord is determined by the size of distance between the cord and the wall of application holes of the application means, whereas this distance is determined by qualitative parameters of the liquid polymeric material, mainly its viscosity.

To ensure constant quality of the liquid polymeric material in the application holes, the liquid polymeric material in a small amount flows out through the application holes through the distance between the wall of the application hole of the application means and the cord.

The goal of the invention is also achieved by a device for application of the liquid polymeric material according to the invention, which principle consists in that there is at least one application means placed in the carrying body of the application device, in which there is made a supply chamber fillable during application with the liquid polymeric material. The supply chamber is connected with external environment by two application holes, through which the cord runs during application without touching its walls, whereas the liquid polymeric material flows out through the distance between the wall of the application hole and the cord to the tank of the application device, from which it is drawn away.

The device secures insulation of the place, where the liquid polymeric material is applied on the cord, from environment, where spinning of the liquid polymeric material runs, which eliminates disadvantages of the background art.

To secure continuous supply of the liquid polymeric material for long-time maintaining the spinning process, the supply chamber is connected with the reservoir of the liquid polymeric material which is formed by the working reservoir of fresh liquid polymeric material.

In case of simpler variant of the device, which is intended for testing of for example ability of spinning of the liquid polymeric materials, the supply chamber is interconnected with the working reservoir of the fresh liquid polymeric material, which is arranged above the supply chamber of the application means, so the liquid polymeric material flows into it by gravity. The outlet of the used liquid polymeric material flowing during application on the cord through the application holes is secured by tank of the application device.

For processing of smaller doses of the liquid polymeric material the supply chamber is equipped with a dosing hole, so the working reservoir of the fresh liquid polymeric material is formed.

To secure stable supply of the liquid polymeric material, especially during long-term operation it is advantageous if there is the dosing device of the liquid polymeric material arranged between the reservoir or the working reservoir of the liquid polymeric material and the application means or number of application means.

With respect to the fact that there is very small amount of the liquid polymeric material needed to supply to the application means, it is advantageous if the dosing device is equipped with a pump capable of supplying with the liquid polymeric material in small separate doses or continuously in small amount.

In a concrete embodiment the carrying body comprises a base body, on which there is mounted a tank equipped with a removable cover. The tank has an inclined bottom sloped down to the base body, in which there is formed a retention vessel for collecting of the used liquid polymeric material which is connected with the waste reservoir of the used liquid polymeric material through flexible pipes, whereas the application means arranged in the carrying body are interconnected by a system of tubes, whereas the first of them is connected to the inlet of the liquid polymeric material, every other one is connected to the previous one and the outlet of the last one is connected to the system of returning of the liquid polymeric material.

For slowly ageing liquid polymeric materials it is advantageous, if the system for returning of the liquid polymeric material comprises return pipe leading to the working reservoir, from which it is retaken for processing. In this variant the used liquid polymeric material is represented by only a part of the liquid polymeric material flowing through the application holes during application of the liquid polymeric material on the cord.

For standard liquid polymeric materials it is sufficient if the system for returning of the liquid polymeric material comprises a constricted overflow or its equivalent, which leads to above of the inclined bottom of the tank.

It is advantageous for all embodiments, if the application holes of the application means have the same diameter.

In terms of quality of the applied layer, it is advantageous for all embodiments, if the cord meets the axis of the application holes.

Other characteristics of the device are specified in the dependent claims.

DESCRIPTION OF THE DRAWINGS

Examples of the embodiment of the device according to the invention are schematically represented in the attached drawings.

The FIG. 1 shows a longitudinal section of the carrying body of the application device with two application means, The FIG. 2 shows a schema of supply of the application means by liquid polymeric material, The FIG. 3*a* shows a view of the arrangement of the application means and the cord, The FIG. 3*b* shows a section of the FIG. 3*a* along the cord, The FIG. 4*a-d* show view, projection and sections of the application means, The FIG. 5 shows another possible embodiment of the application means, The FIG. 6*a-c* show the application device comprising the cord guiding mechanism formed by two pulleys and The FIG. 7*a-b* show the application device comprising the cord guiding mechanism formed by three pulleys.

DESCRIPTION OF EMBODIMENT

Figure 1:
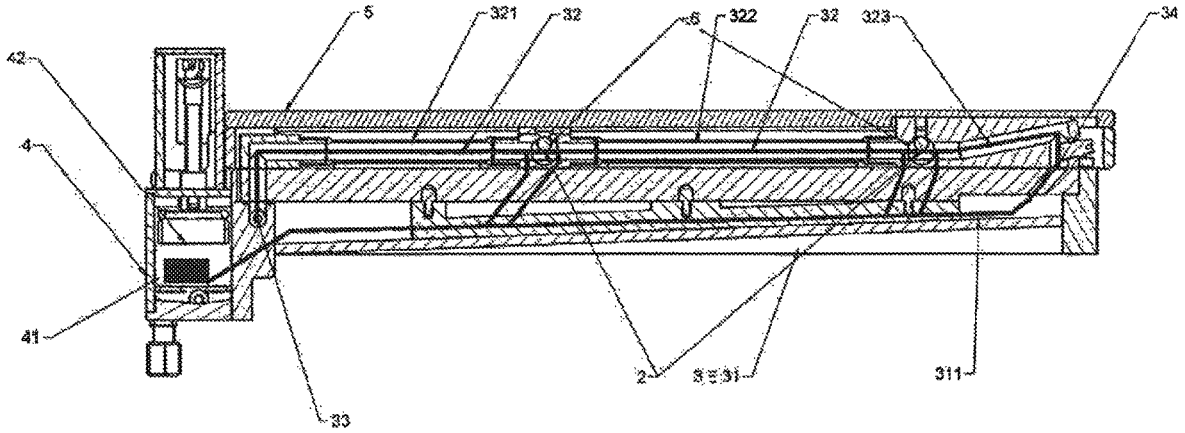

The device for application of the liquid polymeric material on the active spinning zone of the cord of the spinning member of the spinning electrode according to the invention in the example of embodiment shown in the FIG. 1, 3*a*, 3*b* comprises the carrying body 1 common for two cords 2 of the spinning member of the spinning electrode created for example according the EP 2173930 (WO 2009/010020). The carrying body 1 is mounted reversibly displaceably along the active spinning zone of both cords 2 and its main part is the tank 3, which is firmly mounted on the base body 4 and equipped at the upper section with the removable cover 5. The tank 3 is arranged perpendicularly to the cords 2 and is formed by a hollow body 31 opened from above, which has an inclined bottom 311 sloped down to the base body 4. In the cavity of the tank 3 there is arranged a system of tubes 32 whose beginning is connected to an inlet 33 of the liquid polymeric material, which is in the shown embodiment arranged in the base body 4. In places of the cords 2 there are in the system of tubes 32 arranged application means 6 for application of the liquid polymeric material on the active zones of the cords 2. After the last application means 6 there is in the system of tubes 32 arranged a constricted overflow 34 which secures constant overpressure, or constant level of the liquid polymeric material in the system of tubes 32 and in the application means 6. Excess of the liquid polymeric material flows from the constricted overflow 34 to the inclined bottom 311 and, as an effect of sloping, it flows over the bottom 311 into the retention vessel 41, which is formed in the base body 4. In the retention vessel 41 there is arranged freely displaceably a float-gauge 42 coupled with a known not represented evaluation and/or control device. The float-gauge 42 lies on the surface of the liquid polymeric material in the retention vessel 41 and prevents the liquid polymeric material from the contact with air.

Figure 2:
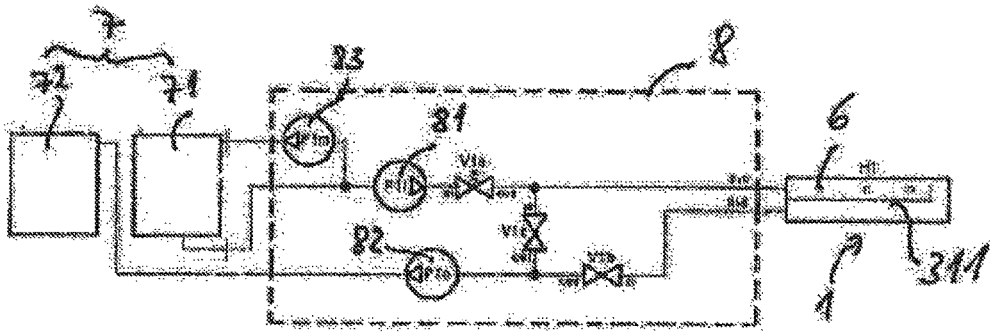
Figure 3A:
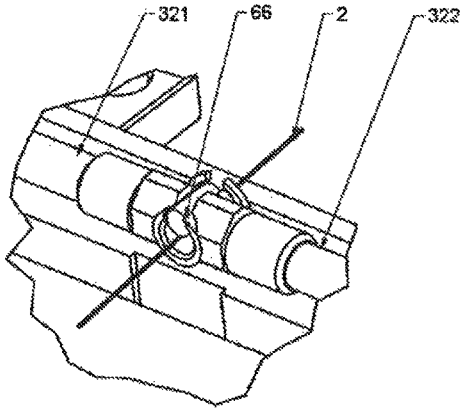
Figure 3B:
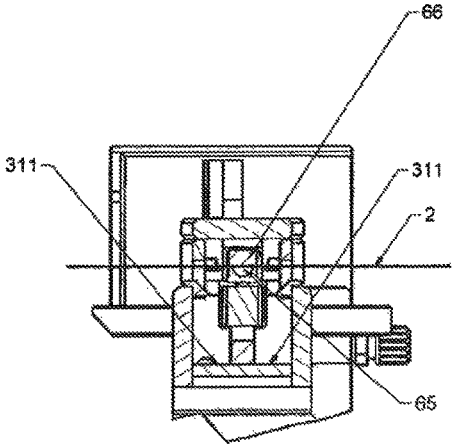
Figure 4A:
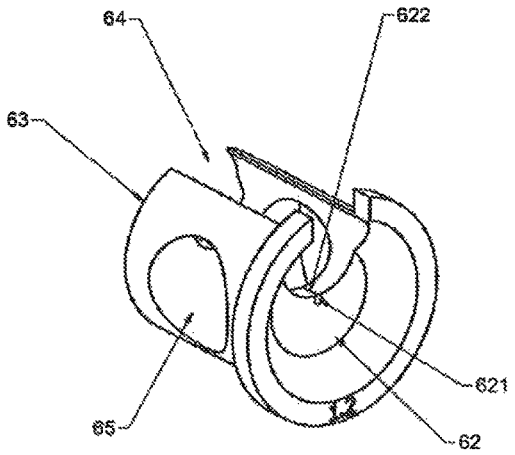
Figure 4B:
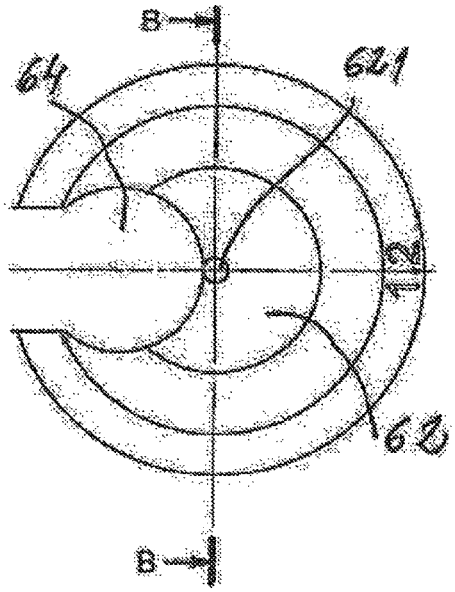
Figure 4C:
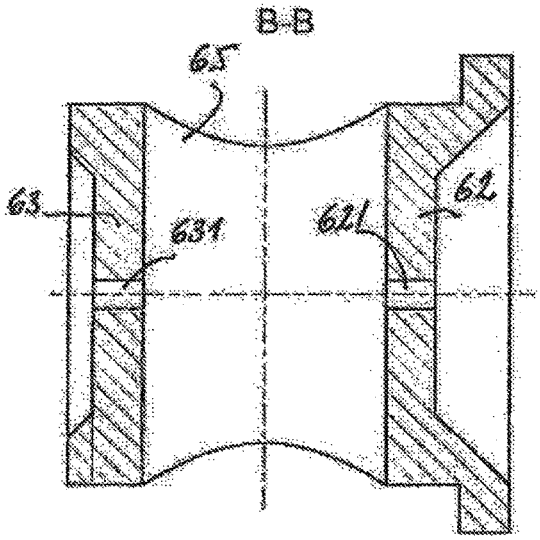
Figure 4D:
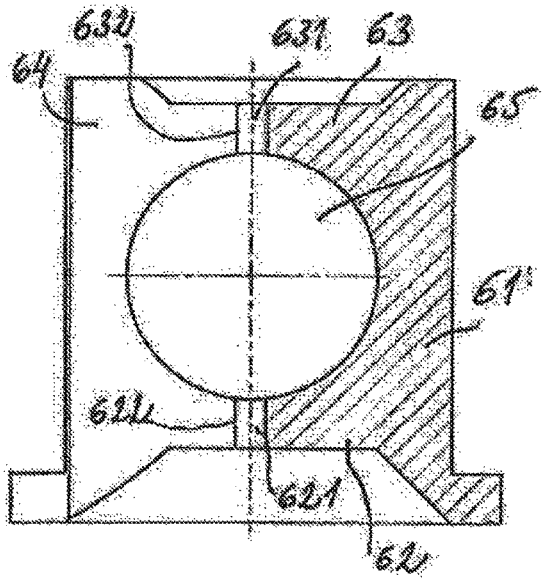

As it is shown in the FIG. 2, the liquid polymeric material is led to the inlet 33 through pipes from the reservoir 7 of the liquid polymeric material, which in the shown embodiment comprises the working reservoir 71 of the fresh liquid polymeric material and the waste reservoir 72 of the used liquid polymeric material.

The application means 6 in the first example of embodiment shown in FIG. 1, 3*a*, 3*b*, 4*a-d*, is formed by a cylindrical body 61 equipped with faces 62 and 63. In the longitudinal axis of the body 61 in the faces 62 and 63 there are made co-axial application holes 621, 631, to which an outward opened axial groove 64, which is parallel to the longitudinal axis of the cylindrical body 61, tangentially ties together by its bottom or to the bottom equivalent inner surface. In the shown embodiment the axial groove 64 is cylindrical but it can be of any shape allowing insertion of an openable and sealing element 66 and secures its sealing function. The bottom or the inner surface equivalent to the bottom of the axial groove 64 in the faces 62, 63 forms the surface tangential to the application holes 621, 631 in the faces, whereas the axial groove 64 and the application holes 621, 631 are interconnected by insertion grooves 622, 632, which allow insertion of the cord 2 into the application holes 621, 631 in the faces 62 and 63 and in a case of a need its removal. Perpendiculary to the axial groove 64 parallel to the longitudinal axis of the cylindrical body 61 there is in the cylindrical body 61 of the application means 6 between the faces 62 and 63 made a supply chamber 65, which is in the shown embodiment formed by a cylindrical hole. To the supply chamber 65 there are connected tubes 32 for an inlet of the liquid polymeric material. The input side of the supply chamber 65 of the first application means 6 is connected through the first tube 321 to the inlet 33 of the liquid polymeric material, the output side of the supply chamber 65 of the first application means 6 is connected through the second tube 322 to the input side of the supply chamber 65 of the second application means 6 and the output side of the supply chamber 65 is connected through the third tube 323 to the constricted overflow 34. The axial groove 64 parallel to the longitudinal axis of the cylindrical body 61 of the application means 6 is intended for insertion of the openable and sealing element 66, which is of the same shape as the axial groove 64 and in the shown embodiment is formed by a sealing cylinder. In a case of a need to apply the liquid polymeric material onto more cords 2, the device has adequate number of the application means 6.

The diameter of the application holes 621, 631 of the application means 6 is bigger than the diameter of the cord 2, whereas the distance between the outer surface of the cord 2 and the wall of the respective application hole 621 or 631, determines, together with both pressure and viscosity of the liquid polymeric material in the system, thickness of the layer of the liquid polymeric material applied on the active zone of the cord 2. The distance is set in a way to avoid trickling. The mutual position of the cord 2 and the application holes 621, 631 of the application means 6 is set in a way to avoid contact of the cord 2 and the walls of the application holes 621, 631 everywhere during reversible movement of the application means 6 along the active zone of the cord 2, whereas it is desirable that the cord 2 is in the axis of both application holes 621, 631 of the application means 6. Set up of the cord 2 to the required position is done by setting of its end points, between which the cord 2 is stretched.

The application of the liquid polymeric material takes place inside the application means 6 in the cavity of the supply chamber 65, which is completely filled with the liquid polymeric material and through which the cord 2 passes transversely. Therefore application takes place in closed space in the absence of air or gaseous medium present in the spinning space around the application means 6, through which the application means 6 reversibly moves during application. during movement of the application means 6 along the active zone of the cord 2, the cord 2 enters the front application hole 621 or 631 of the application means 6 (depending on direction of movement). At the same time, the liquid polymeric material flows through the distance between the cord 2 and the wall of the front application hole 621 or 631 and the liquid polymeric material partially flushes away the residual polymeric material stuck on the cord 2 and flows to the inclined bottom 311 of the tank 3. When the cord 2 leaves the back application hole 631 or 621 of the application means 6, a deposit of the liquid polymeric material is created on the cord 2. According to the type and quality of the surface of the cord 2 and according to the type and viscosity of the liquid polymeric material, the liquid polymeric material creates on the surface of the cord 2 either a continuous film or a set of droplets. So, the deposit of the liquid polymeric material is created inside the application means 6 and amount of the liquid polymeric material on the cord 2 is reduced to required amount by the back application hole 631 or 621 of the application means 6, whereas a part of the liquid polymeric material, which does not stuck on the cord 2, flows down the face of the application means 6 to the inclined bottom 311 of the tank 3 and then down the bottom to the retention vessel 41, in which its surface is covered by the float-gauge 42, which prevents air from access to the polymeric material.

The system of supply of the liquid polymeric material shown in FIG. 2 comprises the working reservoir 71 of the fresh liquid polymeric material, which is connected to the application means 6 through the dosing device 8. The dosing device 8 comprises the pump 81 capable of supplying the liquid polymeric material into the application means 6 in small separate doses or continuously in small amount. Additionally, a mixing pump 83 can be assigned to the working reservoir 71. In the shown embodiment the dosing device 8 is equipped with the drain pump 82, which is interconnected with the retention vessel 41 and with the waste reservoir 72 of the used liquid polymeric material and so forms a system of returning of the liquid polymeric material.

According to another not represented embodiment, the system of returning of the liquid polymeric material can comprise a return pipe connected to the outlet of the last application means 6 and empties into the working reservoir 71 of the liquid polymeric material. This is optimal for slowly ageing liquid polymeric materials. If the liquid polymeric material is not capable for repeated usage, it is led into the waste reservoir 72.

In a simpler variant of the device intended for testing of for example spinning of the liquid polymeric materials, the supply chamber 65 is interconnected with the working reservoir 71 of the fresh liquid polymeric material, which is arranged above the supply chamber 65 of the application means 6, so the liquid polymeric material flows into it by gravity. The outlet of the used liquid polymeric material, flowing during application on the cord 2 through the application holes, is secured by the tank 3 of the application means 6.

For processing even smaller doses of the liquid polymeric material the supply chamber 65 is in another not represented embodiment, equipped with the dosing hole, so it forms the working reservoir of the fresh liquid polymeric material.

Figure 5:
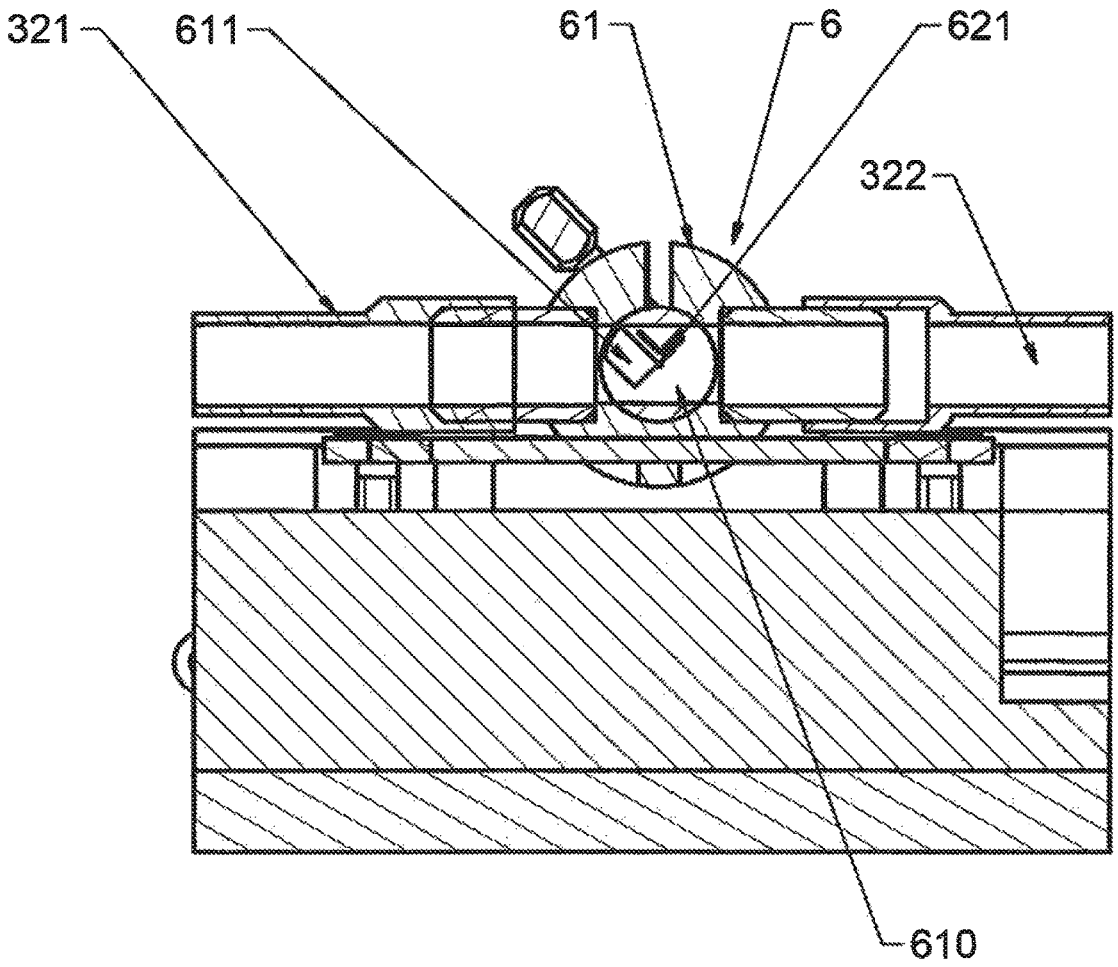

Another possible embodiment of the application means 6 is shown in the FIG. 5. In this embodiment, the application holes 621, 631 are made in the auxiliary body 610, which is rotatingly mounted in a cylindrical body 61 of the application means 6, whereas made in the auxiliary body 610 there is made a guiding groove 611 reaching the application holes 621, 631. The auxiliary body 610 is able to take two positions. At the first position, the guiding groove 611 points out of the body, so the application means can be put on the cord 2. At the second position, the auxiliary body 610 is turned and the guiding groove 611 is closed, so the cord 2 cannot fall off the application holes 621, 631 during application.

To secure a stable position of the cord 2 in the application holes 621, in the application means 6 there is mounted 631 the a guiding mechanism 67 of the cord 2.

Figure 6A:
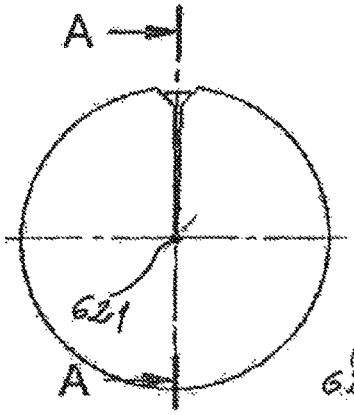
Figure 6B:
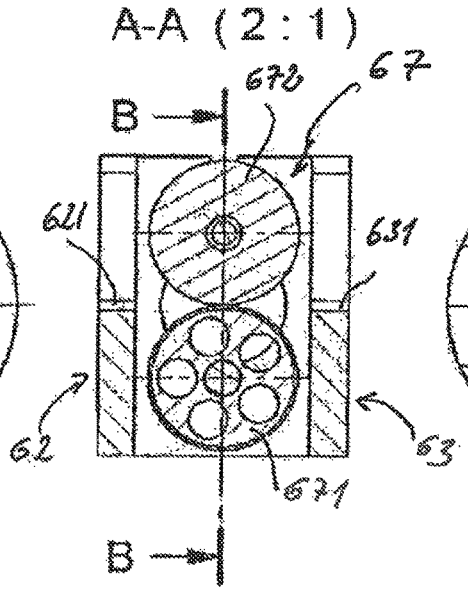
Figure 6C:
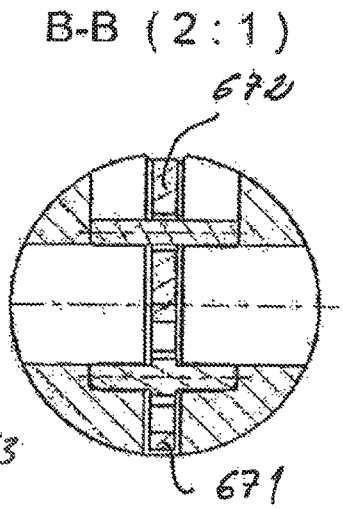

In the embodiment shown in the FIG. 6*a-c*, the supply chamber 65 made inside the application means 6 is extended and two guiding pulleys 671, 672 are rotatingly mounted inside it one above the other. The pulleys 671, 672 are mounted displaceably in the direction perpendicular to their axis and to the axis of the application holes 621, 631 and they are coupled with setting means. The place of the touch of the guiding pulleys 671, 672 lays in the axis of the application holes 621, 631. The cylindrical body 61 of the application means 6 is separated into two parts to enable insertion of the cord between the guiding pulleys, whereas the parting line passes through the axis of the application holes 621, 631. The parting line can be either vertical or horizontal. The bottom guiding pulley 671 is equipped with a groove for guiding of the cord 2 and there are holes made in it to allow the liquid polymeric material to pass through the supply chamber 65 to the next application means 6, whereas the holes serve at the same time for mixing the liquid polymeric material in the supply chamber 65 of the application means 6.

Figure 7A:
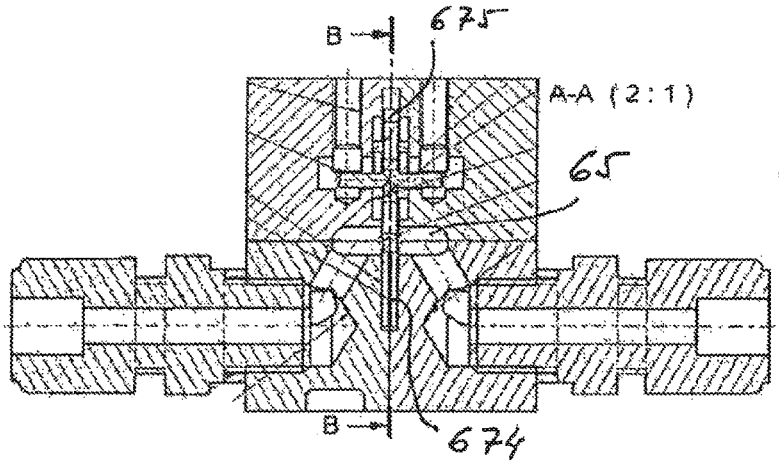
Figure 7B:
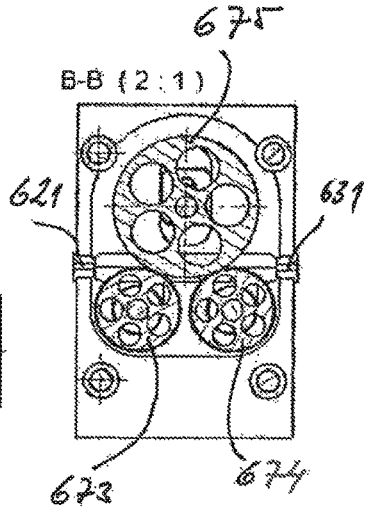

In another embodiment shown in the FIG. 7*a,b*, the cord guiding mechanism comprises two rotatingly mounted guiding pulleys 673, 674 arranged next to each other, whereas their circumferences are arranged tangentially to the axis of the application holes 621, 631. A tentioner pulley 675 reaches between these guiding pulleys 673, 674 by its circumference, it is mounted displaceably in the direction perpendicular to the axis of the application holes 621, 631 and it is coupled with position setting means. This occurs tension of the cord 2 and its precise guidance through the application holes 621, 631. The cylindrical body 61 of the application means 6 is separated into two parts to enable insertion of the cord between the guiding pulleys, whereas the parting line passes through the axis of the application holes 621, 631. The parting line can be either vertical or horizontal. The guiding pulleys 673 and 674 are equipped with a groove for guiding of the cord 2 and there are holes made in them to allow the liquid polymeric material to pass through the supply chamber 65 to the next application means 6, whereas the holes serve at the same time for mixing the liquid polymeric material in the supply chamber 65 of the application means 6. The holes are made also in the tentioner pulley 675.

LIST OF REFERENTIAL MARKINGS

1 carrying body
2 cord of spinning member of the spinning electrode
3 tank
31 hollow body opened from above
311 inclined bottom
32 tube
321 first tube
322 second tube
323 third tube
33 inlet of the liquid polymeric material
34 constricted overflow
4 base body
41 retention vessel
42 float-gauge
5 removable cover of the tank
6 application means
61 body of the application means
610 auxiliary body
611 guiding groove
62, 63 faces of the application means
621, 631 application holes of faces of the application means
622, 632 insert grooves in faces of the application means
64 axial groove
65 supply chamber
66 openable and sealing element
67 cord guiding mechanism
671 bottom guiding pulley
672 top guiding pulley
673, 674 guiding pulleys
675 tentioner pulley
7 reservoir of the liquid polymeric material
71 working reservoir
72 waste reservoir
8 dosing device
81 pump
82 drain pump
83 mixing pump

The invention claimed is:

1. A device for the production of nanofibres through electrostatic spinning of a liquid polymeric material in an electrostatic field, the device comprising:

at least one spinning electrode, means for application of the liquid polymeric material onto an active spinning zone of a cord of a spinning member of the spinning electrode, a carrying body positioned and configured so as to be displaced along the active spinning zone of the cord in a reversible manner, wherein the carrying body is coupled with a drive and with a reservoir for containing the liquid polymeric material, wherein the carrying body includes at least one application means which includes a supply chamber, wherein the supply chamber is interconnected with an external environment by two application holes wherein the cord is positioned to pass through the application holes without touching the walls of the application holes, wherein excess liquid polymeric material flows through the distance between the wall of the application holes and the cord to a tank of the application device.

2. The device according to claim 1, wherein the supply chamber is interconnected with the reservoir of the liquid polymeric material, wherein the reservoir includes a working reservoir of fresh liquid polymeric material and a waste reservoir of used liquid polymeric material.

3. The device according to claim 1, wherein the supply chamber is interconnected with a working reservoir of fresh liquid polymeric material, wherein the working reservoir is arranged above the supply chamber.

4. The device according to claim 1, wherein the supply chamber is equipped with a dosing hole by which a working reservoir of fresh liquid polymeric material is created.

5. The device according to claim 1, wherein between the reservoir or a working reservoir and the application means there is arranged a dosing device of the liquid polymeric material.

6. The device according to claim 5, wherein the dosing device of the liquid polymeric material comprises a pump capable of supplying the liquid polymeric material.

7. The device according to claim 1, wherein the carrying body contains a base body mounted with a tank equipped with a removable cover and having an inclined bottom sloped down to the base body, in which there is made a retention vessel for collecting used liquid polymeric material connected with the waste reservoir of the used liquid polymeric material through flexible pipes, wherein the application means arranged in the carrying body are interconnected by a system of tubes, wherein a first tube is for an inlet of the liquid polymeric material and every subsequent tube is connected to the previous tube and the outlet of the last tube is connected to the system of returning of the liquid polymeric material.

8. The device according to claim 1, wherein the application holes have the same diameter.

9. The device according to claim 1, wherein the cord passes through the axis of the application holes.

10. The device according to claim 1, wherein the application holes are made in the faces of the application means, wherein the application means is equipped with an operable and sealing element for putting the application holes of the application means on the cord.

11. The device according to claim 10, wherein in the application means there is made an outward opened axial groove parallel to the axis of the application holes and tangentially reaching the application holes, wherein the openable and sealing element is closely slidably placed in the axial groove.

12. The device according to claim 1, wherein the application holes are made in the auxiliary body, which is rotatingly mounted in the cylindrical body, wherein in the auxiliary body there is made a guiding groove reaching the application holes.

13. The device according to claim 1, wherein between the application holes in the application means there is mounted the cord guiding mechanism.

14. The device according to claim 13, wherein the body of the application means is separated into two parts, wherein the parting line passes through the axis of the application holes.

* * * * *